US009225060B2

(12) United States Patent
Bair et al.

(10) Patent No.: US 9,225,060 B2
(45) Date of Patent: Dec. 29, 2015

(54) SYSTEM AND METHOD FOR IMPEDANCE MATCHING IN ANTENNAS

(75) Inventors: Chun-Huei Bair, Silver Spring, MD (US); Paul A. Vichot, Eldersburg, MD (US)

(73) Assignee: The Johns Hopkins University, Baltimore, MD (US)

( * ) Notice: Subject to any disclaimer, the term of this patent is extended or adjusted under 35 U.S.C. 154(b) by 271 days.

(21) Appl. No.: 13/550,675

(22) Filed: Jul. 17, 2012

(65) Prior Publication Data

US 2013/0021220 A1 Jan. 24, 2013

Related U.S. Application Data

(60) Provisional application No. 61/508,778, filed on Jul. 18, 2011.

(51) Int. Cl.
*H01Q 1/50* (2006.01)
*H01Q 1/24* (2006.01)

(52) U.S. Cl.
CPC . *H01Q 1/50* (2013.01); *H01Q 1/242* (2013.01)

(58) Field of Classification Search
USPC ..... 343/861, 703, 745, 749
See application file for complete search history.

(56) References Cited

U.S. PATENT DOCUMENTS

| | | | | |
|---|---|---|---|---|
| 5,748,686 | A | 5/1998 | Langberg et al. | |
| 5,751,774 | A | 5/1998 | Wang | |
| 5,828,954 | A | 10/1998 | Wang | |
| 5,875,388 | A | 2/1999 | Daughtry, Jr. et al. | |
| 6,842,198 | B2 | 1/2005 | Suzuki et al. | |
| 6,889,084 | B2 | 5/2005 | Thompson et al. | |
| 7,622,946 | B2 | 11/2009 | Abadeer et al. | |
| 7,885,241 | B2 | 2/2011 | Hashimoto | |
| 2001/0030612 | A1 | 10/2001 | Kerber et al. | |
| 2001/0036811 | A1 | 11/2001 | Kianush et al. | |
| 2003/0112080 | A1 | 6/2003 | Amiot et al. | |
| 2004/0125240 | A1 | 7/2004 | Stikvoort et al. | |
| 2009/0115448 | A1 * | 5/2009 | Abadeer et al. | 326/30 |
| 2009/0128240 | A1 * | 5/2009 | Miyagi | 331/16 |
| 2009/0181626 | A1 * | 7/2009 | Hallivuori | 455/108 |

FOREIGN PATENT DOCUMENTS

| | | |
|---|---|---|
| EP | 0060845 | 2/1986 |
| JP | 4-298122 | 10/1992 |

* cited by examiner

*Primary Examiner* — Sue A Purvis
*Assistant Examiner* — Jae Kim
(74) *Attorney, Agent, or Firm* — Noah J. Hayward

(57) ABSTRACT

A system for use with a transmitter and an antenna includes a radio frequency power detection portion, a tunable matching network, and a phase lock loop. The tunable matching network has a modifiable impedance to account for impedance mismatch between the transmitter and the antenna. The phase lock loop tunes the tunable matching network to modify the modifiable impedance.

2 Claims, 7 Drawing Sheets

SYSTEM AND METHOD FOR IMPEDANCE MATCHING IN ANTENNAS

CROSS-REFERENCE TO RELATED APPLICATIONS

This application claims priority to and the benefit of prior-filed U.S. Provisional Application No. 61/508,778, filed Jul. 18, 2011, the content of which is herein incorporated by reference in its entirety.

BACKGROUND

The present invention relates to radio frequency (RF) impedance matching, and more particularly, to an RF impedance matching network controller.

The performance of an RF antenna is largely influenced by the amount of its impedance. A mismatch of impedance between the antenna impedance and the impedance of a transmission medium can significantly reduce both transmitted and received power of the antenna. Furthermore, an RF antenna is susceptible to significant change in its impedance in response to electromagnetic material coming within close proximity.

To remedy impedance mismatching in an RF antenna, an impedance matching network is attached between the RF antenna and the transmitter or receiver to match their respective impedance. Additionally, the impedance matching network is able to dynamically match the impedance via a controller as the RF antenna's impedance changes.

FIG. 1 illustrates an RF communication system 100 with conventional tunable impedance matching capability.

As illustrated in FIG. 1, RF communication system 100 includes a transmitter 102, an RF power detection portion 104, a tunable matching network 106, an analog to digital converter (ADC) 107, a microprocessor 108, a digital-to-analog converter (DAC) 109 and an antenna 110. RF power detection portion 104 includes an RF coupler 114 and an RF power detector 116.

Transmitter 102 is arranged to provide an electrical transmission signal 118 to RF power detection portion 104 via electrical connection. RF power detection portion 104 is arranged to provide a transmitted signal 120 based on electrical transmission signal 118 to tunable matching network 106 via electrical connection. Tunable matching network 106 is arranged to provide an output signal 122 based on transmitted signal 120 to antenna 110 and to provide a reflected signal 124 to RF power detection portion 104 via electrical connections. Antenna 110 is arranged to output an electromagnetic signal 126 based on output signal 122.

ADC 107 is arranged to receive an analog control signal 128 from RF power detection portion 104 based on reflected signal 124 via an RF coupler 114 and RF power detector 116. ADC 107 is additionally arranged to provide a digital control signal 129 to microprocessor 108. Microprocessor 108 is additionally arranged to provide a digital tuning signal 130 to DAC 109. DAC is additionally arranged to provide an analog tuning signal 131 to tunable matching network 106. RF power detection portion 104, tunable matching network 106, ADC 107, microprocessor 108 and DAC 109 together provide conventional tunable impedance matching capability to transmitter 102 and antenna 110.

Transmitter 102 may be any known RF transmitters or receivers. RF power detection portion 104 may be any known circuits that detect the power level of an RF signal. RF coupler 114 may be any known coupling device that couples transmission power. RF power detector 116 may be any known devices that measure transmission power.

Tunable matching network 106 may include any known circuits or devices that provide impedance matching between a load and a source. Microprocessor 108 may be any known processors, a non-limiting example includes field-programmable gate array (FPGA). Antenna 110 may be any known antenna with an antenna impedance that varies as a function of ambient electromagnetism.

In operation, transmitter 102 transmits electrical transmission signal 118 with an associated transmission power when there is a radio signal to be transmitted. Transmitter 102 transmits electrical transmission signal 118 to RF coupler 114. RF coupler 114 in turn outputs transmitted signal 120 to tunable matching network 106. As transmitter 102 is connected to RF power detection portion 104 electrically, which in turn also connects to tunable matching network 106 electrically, tunable matching network 106 experiences a source impedance $Z_1$ caused by the electrical connections. Antenna 110 has a variable antenna impedance $Z_2$ that varies as a function of ambient electromagnetism. If there is a mismatch between $Z_1$ and $Z_2$, some of the transmission power from electrical transmission signal 118 will be reflected back toward transmitter 102, thus reducing the performance of antenna 110.

Tunable matching network 106 matches source impedance $Z_1$ and antenna impedance $Z_2$ before transmitting output signal 122 to antenna 110. Tunable matching network 106 matches impedance by adding tunable impedance $Z_3$ with antenna impedance $Z_2$ to compensate for any changes in antenna impedance $Z_2$. As a result, the combination of tunable impedance $Z_3$ and antenna impedance $Z_2$ will match with source impedance $Z_1$, ensuring maximum transfer of power to antenna 110 and to minimize reflected signal 124.

As antenna impedance $Z_2$ changes due to change in ambient electromagnetism, tunable matching network 106 continuously outputs reflected signal 124 based on antenna impedance $Z_2$ and tunable impedance $Z_3$ as reflected power to RF power detection portion 104 to keep matching source impedance $Z_1$ and antenna impedance $Z_2$.

Tunable matching network 106 modifies tunable impedance $Z_3$ via analog tuning signal 131 from microprocessor 108. Microprocessor outputs tuning signal 130 based on digital control signal 129 from RF power detection portion 104.

RF power detection portion 104 generates control analog signal 128 based on transmission power from electrical transmission signal 118 and reflected power from reflected signal 124. RF coupler 114 couples reflected signal 124 to generate a transmission power signal 132. RF coupler 114 then transmits transmission power signal 132 to RF power detector 116 for measurement. Based on the amplitude of transmission power signal 132, RF power detector 116 outputs analog control signal 128 to inform microprocessor 108 if any modification is needed to tunable impedance $Z_3$.

When impedance matching is completed by tunable matching network 106, tunable matching network 106 outputs output signal 122 to antenna 110 for transmission. Finally, antenna 110 outputs electromagnetic signal 126, which is based on electrical transmission signal 118, to its destination.

A problem associated with RF communication system 100 with conventional tunable impedance matching capability in FIG. 1 is the relatively high power usage, high response, and complexity associated with microprocessor 108 in order to control tunable matching network 106.

What is needed is a system to perform impedance matching for use with a transmitter and an antenna that offers low power usage, low response time, and simplicity.

BRIEF SUMMARY

Example embodiments of the present invention include a system and method for performing impedance matching for use with a transmitter and an antenna that offers low power usage, low response time, and simplicity.

In accordance with an example embodiment of the present invention, a system is provided for use with a transmitter and an antenna. The transmitter can output an electrical transmission signal, whereas the antenna can output an electromagnetic signal based on the electrical transmission signal. The antenna has an antenna impedance that varies as a function of ambient electromagnetism. The system includes an RF power detection portion, a tunable matching network, and a PLL. The RF power detection portion can output a transmitted signal based on the transmission signal. The tunable matching network has a modifiable impedance and can output an output signal based on the transmitted signal and can reflect a reflected signal to the RF power detection portion. The reflected signal is based on the antenna impedance and the tunable impedance. Further, the RF power detection portion can output a control signal based on the reflected signal. The PLL can output a tuning signal based on the control signal. The tunable matching network can modify the modifiable impedance based on the tuning signal to attenuate the reflected signal.

Additional advantages and novel features of example embodiments of the invention are set forth in part in the description which follows, and in part will become apparent to those skilled in the art upon examination of the following or may be learned by practice of example embodiments of the invention. The advantages of the invention may be realized and attained by means of the instrumentalities and combinations particularly pointed out in the appended claims.

BRIEF DESCRIPTION OF THE DRAWINGS

The accompanying drawings, which are incorporated in and form a part of the specification, illustrate an exemplary embodiment of the present invention and, together with the description, serve to explain the principles of the invention. In the drawings.

DETAILED DESCRIPTION

In accordance with an example embodiment of the present invention, a phase-locked loop (PLL) is used as a controller for a tunable matching network to dynamically provide RF impedance matching for an antenna and a transmitter. The PLL receives a direct current (DC) voltage from a power detection portion that couples transmission power and reflect power from the transmitter and the antenna respectively to produce an output frequency. The PLL compares the output frequency with a reference frequency; the resulting error signal is proportional to the amount of impedance mismatch and is sent as a tuning signal to a tunable matching network to modify its impedance.

In accordance with another example embodiment of the present invention, a polarity conditioner is used in conjunction with the PLL to control the tunable matching network for dynamic impedance matching. The polarity conditioner determines the polarity of the impedance adjustment based on the amount of change for transmission power and reflect power, while the PLL determines the amount of impedance adjustment.

In accordance with these aspects, an example embodiment of the present invention detects the amount and the polarity of impedance mismatching between a source impedance and an antenna impedance, dynamically modifies a tunable impedance to compensate for the impedance mismatching.

Example embodiments of the present invention may be applied to many RF communication systems, such as cellular phone, cordless phone, etc. In the non-limiting example embodiment, a cellular phone is discussed.

Example embodiments in accordance with example embodiments of the present invention will now be described with reference to FIGS. 2-7.

Figure 1:
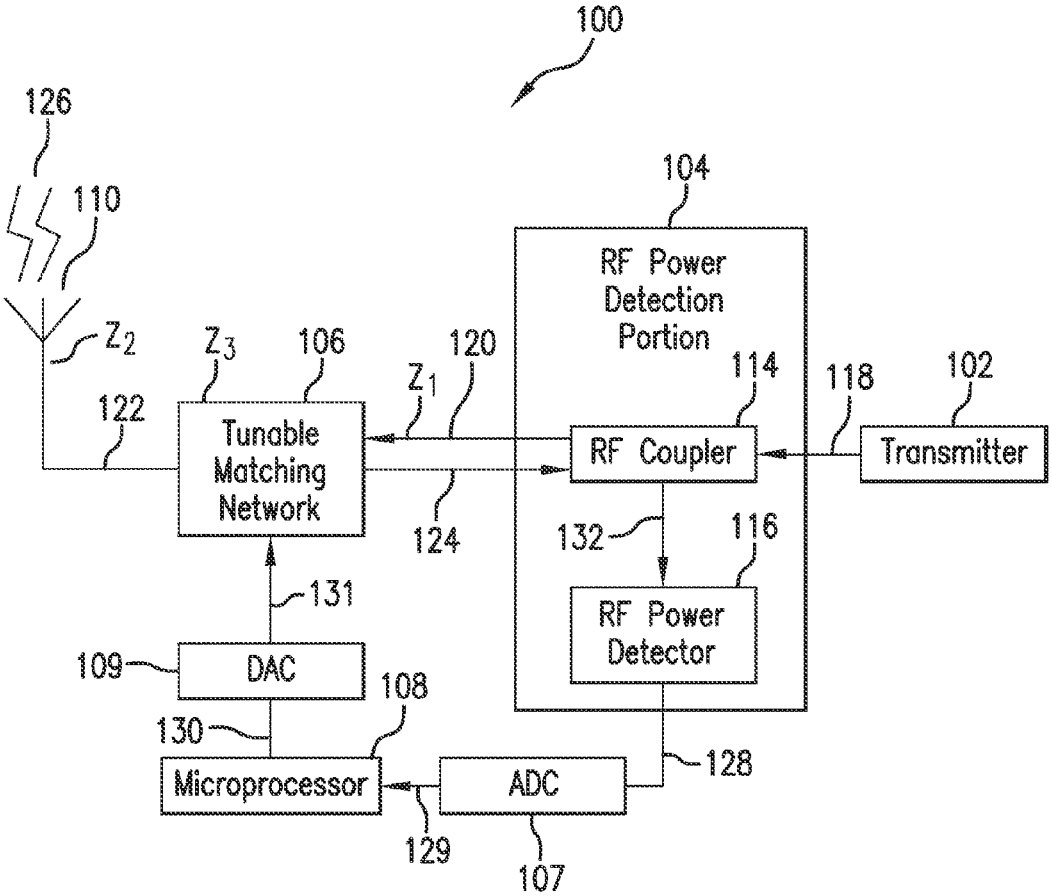
FIG. 1 Prior ART
FIG. 1 illustrates an RF communication system with conventional tunable impedance matching capability.
Figure 2:
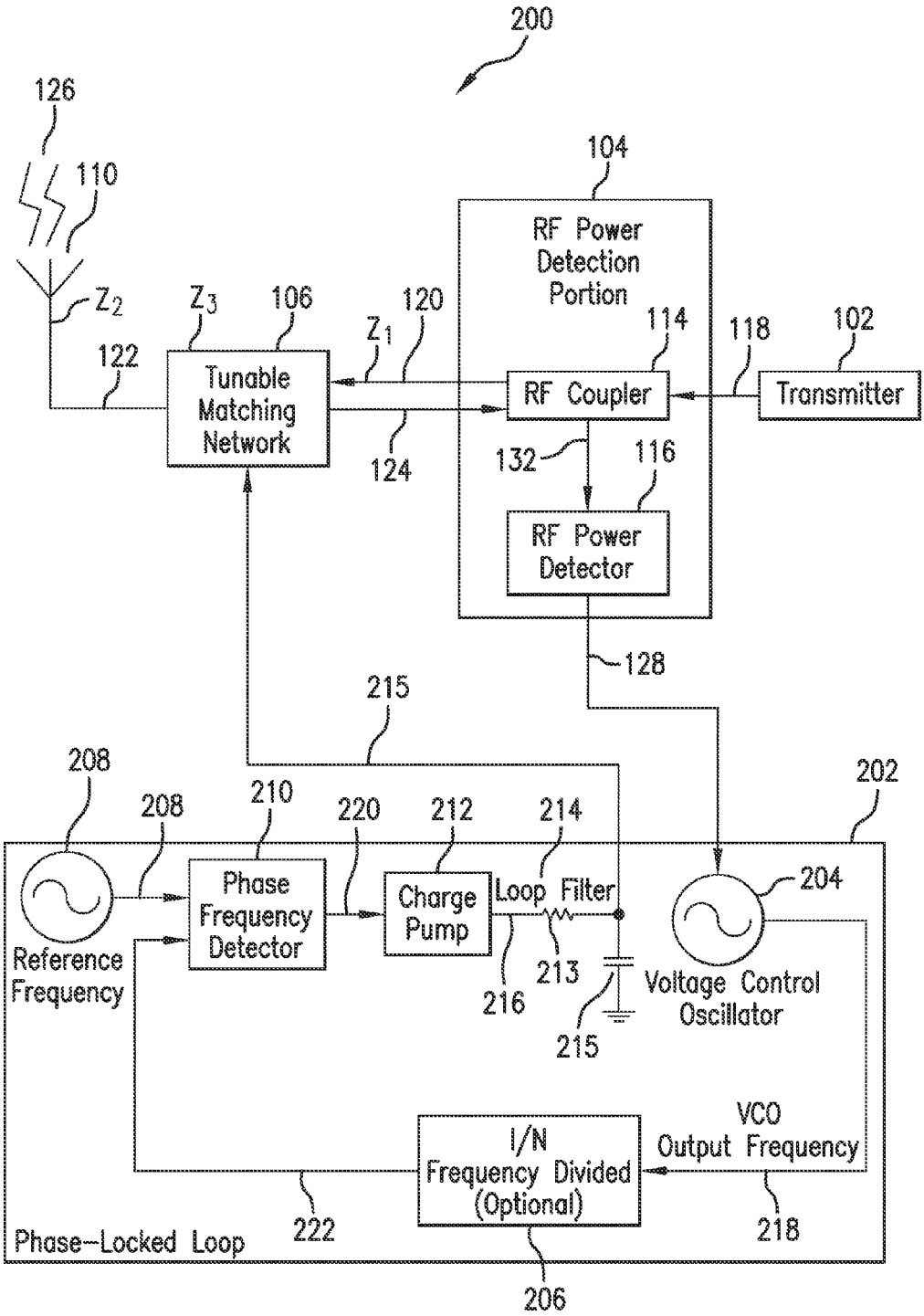
FIG. 2 illustrates an RF communication system with a system for use with a transmitter and an antenna in accordance an example embodiment of the present invention.

FIG. 2 is a block diagram of an RF communication system 200 with a system 202 for use with transmitter 102 and an antenna 110 in accordance with an example embodiment of the present invention.

As illustrated in FIG. 2, RF communication system 200 includes transmitter 102, RF power detection portion 104, tunable matching network 106, antenna 110, and phase-locked loop (PLL) 202. PLL 202 includes a voltage control oscillator (VCO) 204, an optional frequency divider 206, a reference frequency 208, a phase frequency detector 210, a charge pump 212, and a loop filter 214. Loop filter 214 includes a filter resistor 213 and a filter capacitor 215.

PLL 202 is arranged to receive control signal 128 from RF power detection portion 104. Analog control signal 128 is based on reflected signal 124 via an RF coupler 114 and RF power detector 116. PLL 202 is additionally arranged to transmit an analog tuning signal 215 to tunable matching network 106 for impedance matching adjustment.

VCO 204 is arranged to provide a VCO output frequency 218 to phase frequency detector 210 as an input. Phase frequency detector 210 is arranged to provide a phase difference signal 220 to charge pump 212. Charge pump 212 is arranged to provide analog tuning signal 215 to tunable matching network 106. Loop filter 214 is arranged to filter analog tuning signal 215 through specific frequency bands. An optional frequency divider may be arranged to divide VCO output frequency 218 into a multiple of the output frequency as a divided signal 222.

RF communication system 200 may be a cellular phone. PLL 202 may be any known phase-locked loops. VCO 204 may be an electronic oscillator. Reference frequency 208 may be a stable frequency source. Phase frequency detector 210 may be a circuit that generates a voltage signal which represents a phase difference between two signal inputs. Charge pump 212 may be a circuit that produces a higher or lower voltage source signal based on a phase difference. Loop filter 214 may be a low pass filter.

A PLL circuit is widely used in radio, telecommunications, and other electronic applications. A PLL essentially works to synchronize the output phase and frequency of a controllable oscillator to match the output phase and frequency of a reference oscillator. In this way, a PLL can also be used to synthesize multiple frequencies from a single reference oscillator. Thus, PLLs are often used to generate stable frequencies for use as clocks in other circuits (e.g., analog to digital converters, microprocessors, etc.).

In operation of PLL 202, phase frequency detector 210 receives reference frequency 208 from an external oscillator (not shown). Phase frequency detector 210 compares the phase of reference frequency 208 to that of VCO output frequency 218 (or to that of divided signal 222). Depending on the phase difference, phase frequency detector 210 then outputs a pulse of specific duration phase difference signal 220. An up pulse of phase difference signal 220 causes charge pump 212 to add charge to filter capacitor 215, whereas a down pulse of phase difference signal 220 causes charge pump 212 to remove charge from filter capacitor 215. As charge is added or removed from filter capacitor 215, the voltage of analog tuning signal 215 is thereby increased or decreased. As will be discussed below, this eventually causes an increase or decrease in analog control signal 128, which increases or decreases the frequency of VCO output frequency 218. The phase of VCO output frequency 218 is then again compared to that of reference frequency 208, and the cycle repeats again. In this manner, the phase and frequency of VCO output frequency 218 is repeatedly adjusted to eventually match that of reference frequency 208.

Once the phase and frequency of VCO output frequency 218 (or to that of divided signal 222) matches that of reference frequency 208, PLL 202 is considered to be in the "locked" state, and mainly functions to maintain a constant voltage at analog control signal 128, such that VCO output frequency 218 (or to that of divided signal 222) remains "locked" to that of reference frequency 208. This is implemented by phase frequency detector 210 outputting identical up and down pulses on up pulse of phase difference signal 220, such that no net charge is transferred to filter capacitor 115, thus allowing the voltage at analog control signal 128 to remain constant.

PLL 202 is merely an example PLL, wherein only the fundamental components of a typical PLL were shown, for simplicity in the explanation of basic PLL functionality. In practice, PLLs typically implement another important component known as a frequency divider. A frequency divider is a circuit that takes an input signal with frequency, $f_{in}$, and produces an output signal with frequency $f_{out}$, where $f_{out}=f_{in}/n$, and n is an integer. Most PLLs include a divider in the feedback loop, between the VCO output and the feedback input to the phase detector (often referred to as a "feedback divider"). In this manner, the PLL can serve as a frequency synthesizer and produce a range of frequencies from a single fixed reference input (typically a crystal oscillator). Some PLLs also include a divider between the external crystal oscillator and the reference input to the phase detector (often referred to as a "reference divider"). In this case, PLL 202 may optionally include frequency divider 206, which may provide a wider selection of commercial off-the-shelf PLL chips In operation of RF communication system 200 as a whole, transmitter 102 transmits electrical transmission signal 118 with an associated transmission power when there is a radio signal to be transmitted. Transmitter 102 transmits electrical transmission signal 118 to RF coupler 114. RF coupler 114 in turn outputs transmitted signal 120 to tunable matching network 106. Tunable matching network 106 matches source impedance $Z_1$ with antenna impedance $Z_2$ via tunable impedance $Z_3$ while transmitting output signal 122 to antenna 110 where antenna 110 transmits electromagnetic signal 126 to the intended destination of electrical transmission signal 118.

Because antenna impedance $Z_2$ varies as a function of ambient electromagnetism, tunable matching network 106 provides reflected signal 124 based on antenna impedance $Z_2$ and tunable impedance $Z_3$ to RF power detection portion 104 as an indication of the amount of impedance mismatch.

RF power detection portion 104 couples reflected signal 124 to produce transmission power signal 132 at RF coupler 114. RF coupler 114 transmits transmission power signal 132 to RF power detector 116 for RF power measurement. RF power detector 116 then outputs analog control signal 128 to PLL 202 for impedance compensation adjustment.

Analog control signal 128 drives VCO 204 in the form of a voltage input signal, wherein VCO 204 outputs a VCO output frequency 218 to phase frequency detector 210. In a non-limiting example embodiment, VCO output frequency 218 is divided into a rational multiple of reference frequency 208 by optional frequency divider 206 before entering phase frequency detector 210.

Phase frequency detector 210 compares the phase difference between reference frequency 208 and VCO output frequency 218. The value of reference frequency 208 may be chosen based on predetermined source impedance $Z_1$ as source impedance $Z_1$ is typically a stable value. Phase frequency detector 210 outputs phase difference signal 220 by comparing the phase of VCO output frequency 218 with reference frequency 208. The resulting phase difference signal 220 that is indicative of the amount of impedance mismatch between source impedance $Z_1$ and antenna impedance $Z_2$.

Phase frequency detector 210 outputs phase difference signal 220 to charge pump 212 to generate analog tuning signal 215. Analog tuning signal 215 is filtered through loop filter 214 before being fed to tunable matching network 106.

Tunable matching network 106 modifies tunable impedance $Z_3$ based on analog tuning signal 215 to compensate for the impedance mismatch between source impedance $Z_1$ and antenna impedance $Z_2$. As a result of tunable matching network 106 modifying tunable impedance $Z_3$, reflected signal 124 should be minimized since the amount of impedance mismatch is minimized.

Tunable matching network 106 is able to dynamically modify tunable impedance $Z_3$ to compensate for an impedance mismatch between source impedance $Z_1$ and antenna impedance $Z_2$. Unfortunately, the dynamic modification of tunable impedance $Z_3$ is based on an absolute difference between source impedance $Z_1$ and antenna impedance $Z_2$. In RF communication system 200, the dynamic modification of tunable impedance $Z_3$ cannot distinguish between: a first situation where an impedance mismatch, say $\Delta Z$, results from source impedance $Z_1$ being larger than antenna impedance $Z_2$, i.e., $Z_1-Z_2=\Delta Z$; and a second situation where an impedance mismatch, say $\Delta Z$, results from antenna impedance $Z_2$ being larger than source impedance $Z_1$, i.e., $Z_2-Z_1=\Delta Z$. Accordingly, there may be times when PLL 202 may instruct tunable matching network 106 to increase tunable impedance $Z_3$, when tunable impedance $Z_3$ should actually have been decreased.

The change in magnitude of reflected signal 124 is indicative of the performance of transmitter 102. If reflected signal 124 is increasing, it indicates that there is more transmission power reflected back to transmitter 102, thus lowering the performance of transmitter 102. If reflected signal 124 is decreasing, it indicates that there is less transmission power reflected back to transmitter 102, thus transmitter 102 is more effective.

Therefore, in accordance with another example embodiment of the invention, a polarity conditioner is used in conjunction with PLL 202 to provide for impedance matching with the correct polarity by automatically matching the polarity of a tuning signal with the polarity of analog control signal 128. This will be further described with reference to FIGS. 3-7.

Figure 3:
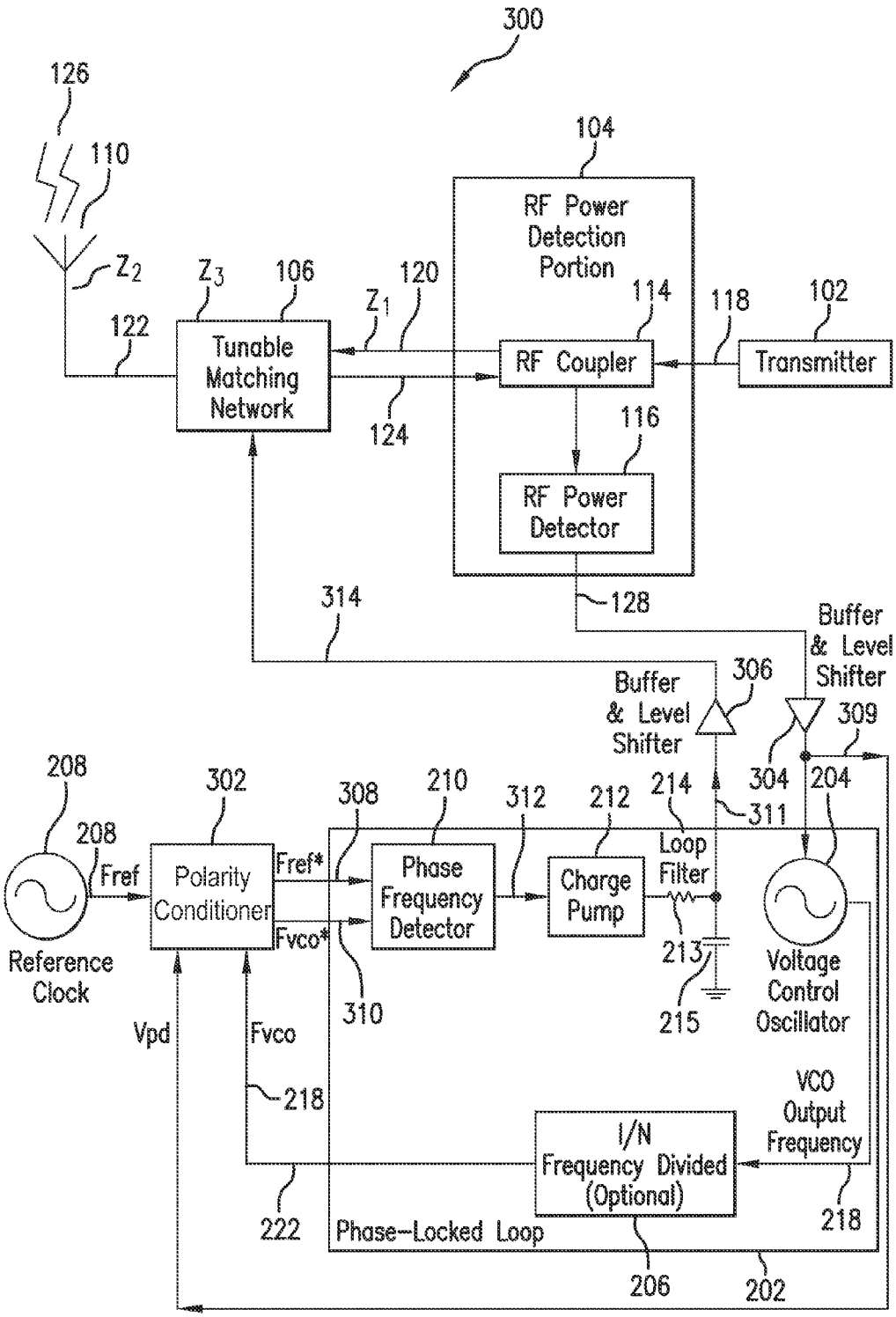
FIG. 3 illustrates an RF communication system with the system of FIG. 2 and a polarity conditioner for use with a transmitter and an antenna in accordance with an example embodiment of the present invention.

FIG. 3 illustrates an RF communication system 300 with a polarity conditioner 302 in accordance with an example embodiment of the present invention.

As illustrated in FIG. 3, RF communication system 300 includes transmitter 102, RF power detection portion 104, tunable matching network 106, antenna 110, and phase-locked loop (PLL) 202, a polarity conditioner 302, a buffer 304 and a buffer 306.

RF power detection portion 104 is arranged to provide analog control signal 128 to PLL 202 through buffer 304 as a voltage input signal. RF power detection portion 104 is additionally arranged to provide analog control signal 128 to polarity conditioner 302 as an input. Buffer 304 is arranged to provide a voltage level change to analog control signal 128 if necessary.

VCO 204 is arranged to provide VCO output frequency 218 to polarity conditioner 302 as an input. In a non-limiting example embodiment, VCO output frequency 218 is divided by optional frequency divider 206 before being fed to polarity conditioner 302. Reference frequency 208 is fed into polarity conditioner 302 as an input.

Polarity conditioner 302 is arranged to provide a signed reference frequency 308 and a signed output frequency 310 to phase frequency detector 210 as inputs, so that the polarity of tuning signal 314 will not necessarily have the same polarity as analog control signal 128. Phase frequency detector 210 is arranged to provide a signed phase difference signal 312 to charge pump 212 to generate a tuning signal 314.

Loop filter is arranged to filter tuning signal 314. Buffer 306 is arranged to provide a voltage level change to tuning signal 314 if necessary.

In operation, RF power detection portion 104 transmits analog control signal 128 to VCO 204 through buffer 304. Additionally, RF power detection portion 104 transmits analog control signal 128 to polarity conditioner 302. VCO 204 outputs VCO output frequency 218 to polarity conditioner 302. Reference frequency 208 is also fed to polarity conditioner 302.

Polarity conditioner 302 monitors the magnitude of analog control signal 128 and switches the polarity of the tuning signal 314 if the magnitude of analog control signal 128 is increasing. This will be further described with reference to FIG. 4 below.

Figure 4:
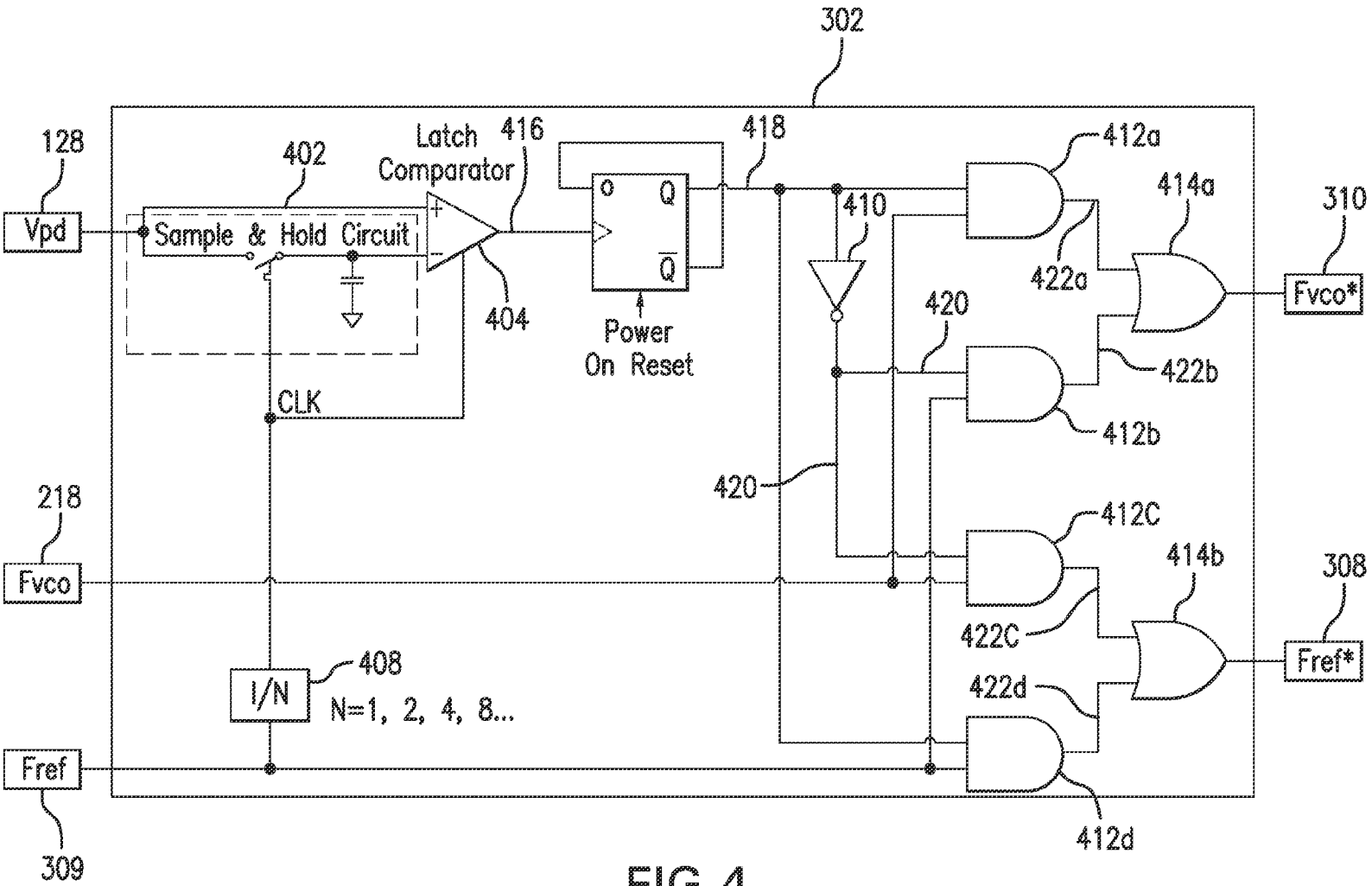
FIG. 4 is a circuit diagram of the polarity conditioner of FIG. 3.

FIG. 4 is a circuit diagram of polarity conditioner 302 as shown in FIG. 3.

As shown in FIG. 3, polarity conditioner 302 includes a sample and hold (SH) circuit 402, a latched comparator 404, a switch 406, an optional frequency divider 408, an inverter 410, an AND gate 412*a*, an AND gate 412*b*, AND gate 412*c*, AND gate 412*d*, an OR gate 414*a*, and an OR gate 414*b*.

SH circuit 402 is arranged to take samples of analog control signal 128. Latched comparator 404 is arranged to provide a comparison result 416 to switch 406. Switch 406 is arranged to provide a binary input 418 to AND gates 412*a*-412*d* respectively. Inverter 410 is arranged to invert the value of binary input 418. AND gates 412*a*-412*d* and OR gates 414*a*, 414*b* are arranged to output signed reference frequency 308 and signed output frequency 310. VCO output frequency 218 is arranged to be an input for AND gate 412*a* and AND gate 412*c*. Reference frequency 208 is arranged to be an input for AND gate 412*b* and AND gate 412*d*.

SH circuit 402 may be a sampling circuit. Latched comparator 404 may be a latch. Switch 406 may be a D-type flip flop. AND gates 412*a*-412*d* may be logic AND gates. OR gates 414*a* and 414*b* may be logic OR gates. This will be described in more detail with reference to FIG. 5.

Figure 5:
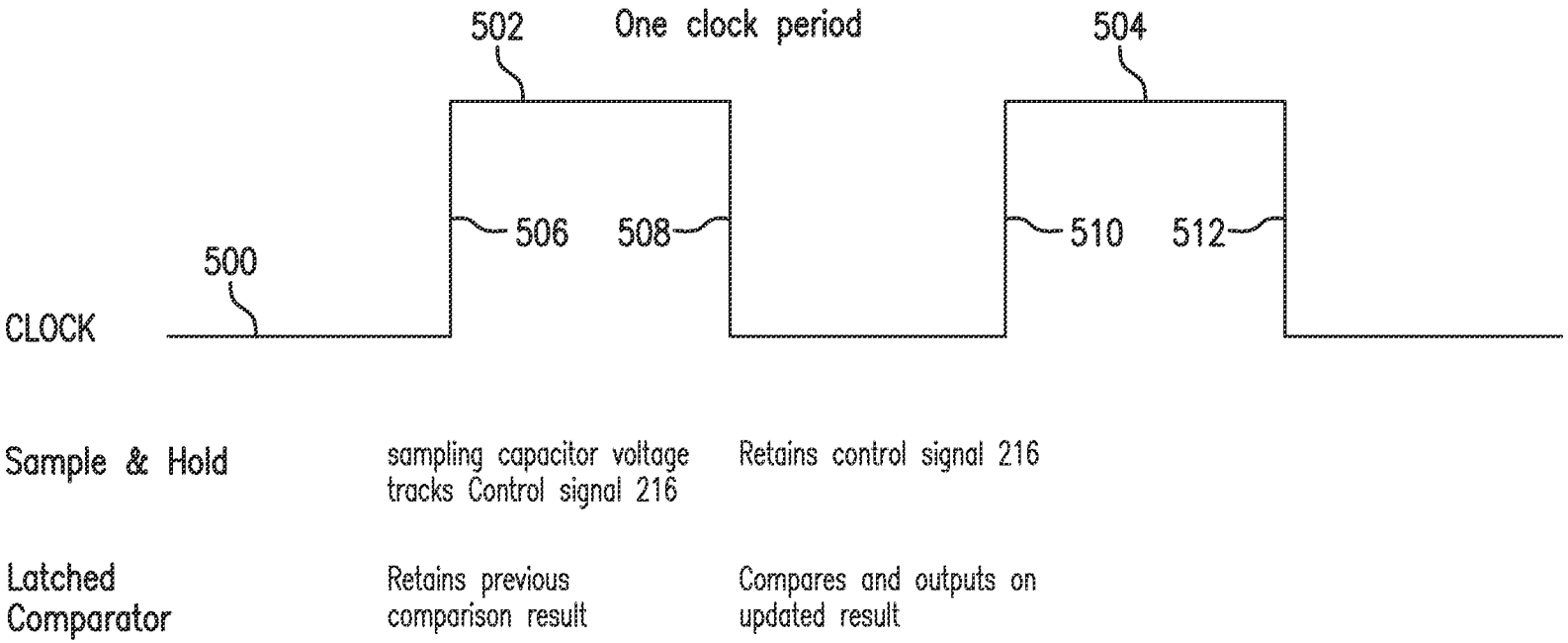
FIG. 5 is an example timing diagram of the polarity conditioner of FIG. 3.

FIG. 5 is an example timing diagram of the polarity conditioner of FIG. 3.

As shown in FIG. 5, a clock signal 500 includes a first pulse 502 and a second pulse 504. First pulse 502 includes a rising edge 506 and a falling edge 508, whereas second pulse 504 includes a rising edge 510 and a falling edge 512.

In operation, in a "1" in clock signal 500 (which in this example is between rising edge 506 and falling edge 508), analog control signal 128 is tracked by the SH circuit 402 and is held at the end of the period. During this period, the comparator output is latched to the previous comparator output. In the "0" clock period, analog control signal 128 is fed into comparator 404 for comparison with the held value.

Latched comparator 404 outputs comparison result 416, non-limiting examples include signal "1" or "0", to switch 406. Comparison result 416 is indicative of the polarity of analog control signal 128. Switch 406 outputs binary input 418 based on comparison result 416 as inputs to AND gates 412*a* and 412*d*. Inverter 410 inverts the value (e.g. from "0" to "1" or vice versa) of binary input 418 to generate an inverted binary input 420 as inputs to AND gates 412*b* and 412*c*.

AND gates 412*a* and 412*b* output logic signal 422*a* and 422*b* as inputs to OR gate 414*a* respectively based on the value of binary input 418. Similarly, AND gates 412*c* and 412*d* output logic signal 422*c* and 422*d* as inputs to OR gate 414*b* respectively based on the value of inverted binary input 420.

Based on the values of logic signal 422*a* and 422*b*, OR gate 414*a* will output signed output frequency 310 that may have the same value as VCO output frequency 218 or reference frequency 208.

Similarly, based on the values of logic signal 422*c* and 422*d*, OR gate 414*b* will output signed reference frequency 308 that may have the same value as VCO output frequency 218 or as reference frequency 208.

During the "0" in clock signal 500 (which in this example includes the portion between falling edge 508 and rising edge 510), when the current analog control signal 128 is greater than the previous sample of analog control signal 128, the value of comparator output 416 is "1." The value of comparator output 416 is "0" when the current analog control signal 128 is smaller than the previous sample of analog control signal 128. Switch 406 outputs binary input 418 based on comparator output 416 and it toggles when comparator output 416 changes from "0" to "1", otherwise it remains same value.

When the value of binary input 418 is "1", OR gate 414*a* outputs signed output frequency 310 with the same value and polarity as VCO output frequency 218, OR gate 414*b* outputs signed reference frequency 308 with the same value as reference frequency 208. When the value of binary input 418 is "0", OR gate 414*a* outputs signed output frequency 310 with the same value and polarity as reference frequency 208, OR gate 414*b* outputs signed reference frequency 308 with the same value as VCO output frequency 218.

Thus, depending on the polarity of analog control signal 128, polarity conditioner will set the polarity of tuning signal 314 by changing the value of signed reference frequency to the value of reference frequency 208 or VCO output frequency 218.

Returning to FIG. 3, polarity conditioner 302 outputs signed reference frequency 308 and signed output frequency 310 to phase frequency detector 210 for phase difference detection. Because the values of signed reference frequency 308 and signed output frequency 310 are determined based on the magnitude of analog control signal 128, phase frequency detector 210 will cause charge pump 212 to switch the polarity of tuning signal 314 if the magnitude of analog control signal 128 is increasing via signed phase difference signal 312.

As a result, tunable matching network 106 modifies tunable impedance $Z_3$ with the correct amount and the correct polarity upon receiving tuning signal 314 from PLL 202. This will be further described with additional reference to FIG. 6.

Figure 6:
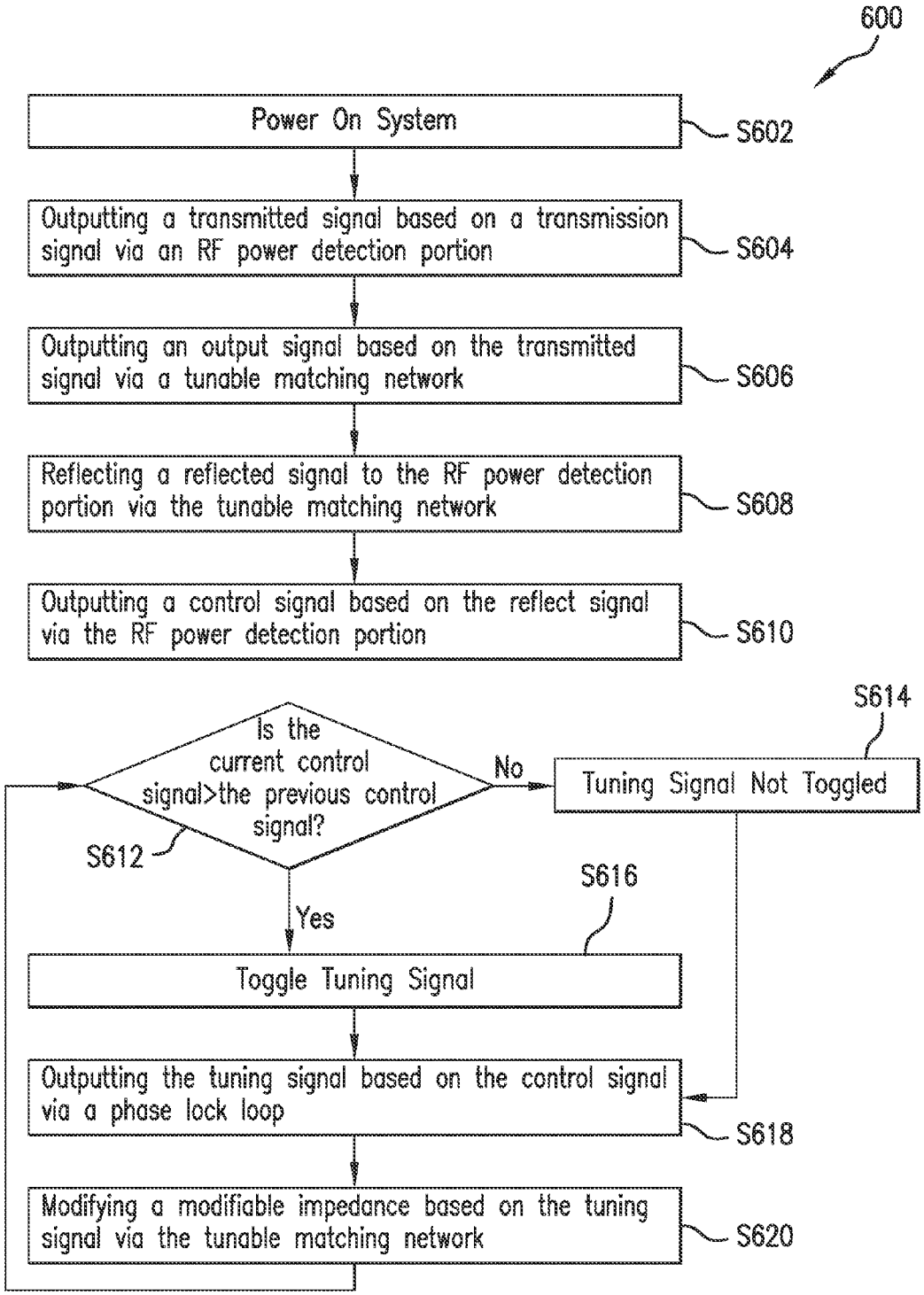
FIG. 6 is a flow diagram illustrating the general operation of the polarity conditioner of FIG. 3 and the system of FIG. 2.

FIG. 6 is a flow diagram illustrating a method 600 of using the polarity conditioner 302 and PLL 202.

Method 600 starts, and a transmission system is powered or reset (S602). For example, RF communication system 300 is powered. As shown in FIG. 4, a power on reset or system reset signal will set switch 406 output 418 to "0."

Then, a transmitted signal based on a transmission signal is outputted via an RF power detection portion (S604). For example, returning to FIG. 3, the transmitted signal is transmitted signal 120, the transmission signal is electrical transmission signal 118 and the RF power detection portion is RF power detection portion 104.

Then an output signal is outputted based on the transmitted signal via a tunable matching network (S606). As shown in FIG. 3, the output signal is output signal 122, whereas the tunable matching network is tunable matching network 106.

Then a reflected signal is reflected to the RF power detection portion via the tunable matching network (S608). As shown in FIG. 3, the reflected signal is reflected signal 124.

A control signal is then outputted based on the reflect signal via the RF power detection portion (S610). As shown in FIG. 3, the control signal may be analog control signal 128.

It is then determined whether the control signal is greater than the previous control signal (S612). For example, as shown in FIG. 3, polarity conditioner 302 will determine whether the current control signal is greater than the previous control signal. If it is determined that the current control signal is not greater than the previous control signal, then the tuning signal polarity is not toggled (S614).

If the control signal is greater than the previous control signal (yes S614), the tuning signal polarity is toggled (S616).

After a tuning signal is generated (either S612 or S616), the tuning signal is outputted based on the control signal via a phase lock loop (S618). As shown in FIG. 3, the phase lock loop is PLL 202.

At this point a modifiable impedance is modified based on the tuning signal via the tunable matching network (S620) and method 600 loops back to the next comparison (S612).

The modifiable impedance is modified based on the tuning signal with a correct polarity via the tunable matching network to provide for impedance matching. Having a correct polarity by the tuning signal is an important aspect of impedance matching. This will be further described with references to FIGS. 7-8.

Figure 7:
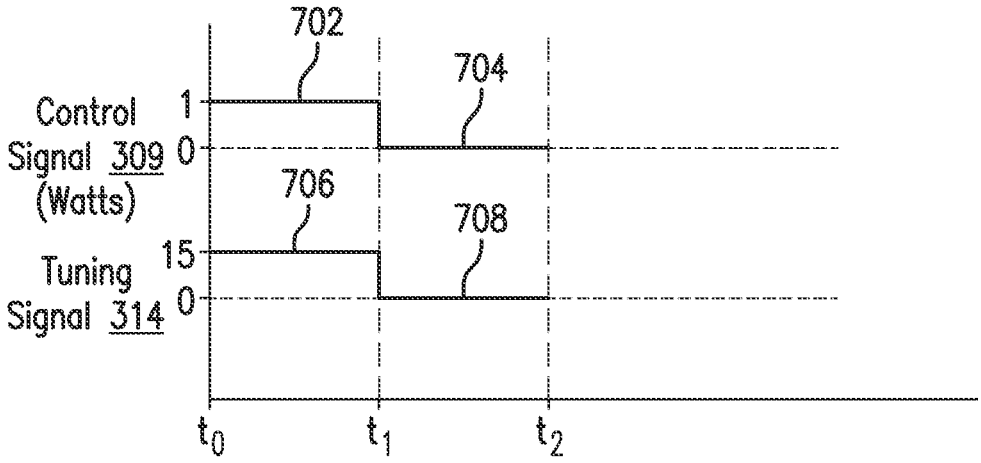
FIG. 7 is a wave diagram illustrating the operation of the polarity conditioner of FIG. 3 and the system of FIG. 2 in a first scenario.

FIG. 7 is a wave diagram illustrating the operation of polarity conditioner 302 and PLL 202 in a first scenario.

The figure includes examples of analog control signal 128 and tuning signal 314 as shown in FIG. 3.

Analog control signal 128 includes a first reflected power level 702 from time $t_0$ to $t_1$ and a second reflected power level 704 from time $t_1$ to $t_2$. Tuning signal 314 includes a first modification value 706 from time $t_0$ to $t_1$ and a second modification value 708 from time $t_1$ to $t_2$.

In this example, at time $t_1$, first reflected power level 702 may have a value of 1 watt, indicating the amount of reflected power back to transmitter 102, whereas first modification value 706 may have a value of 15, indicating the amount of change tunable matching network 106 should apply to modify tunable impedance $Z_3$.

At time $t_2$, second reflected power level 804 has been decreased to 0 watt. This decrease indicates that tunable matching network 106 has modified tunable impedance $Z_3$ in the correct direction and there is no more impedance mismatch between source impedance $Z_1$ and antenna impedance $Z_2$. In this scenario, there is no change to the polarity of tuning signal 314 as tunable matching network 106 has modified tunable impedance $Z_3$ in the correct direction.

FIG. 7 illustrates that situation where a current control signal is less than a previous controls signal, as discussed above with reference to FIG. 6 (S614 No). In this situation, tunable impedance $Z_3$ was modified in the correct direction, thus the reflected signal was decreased.

Figure 8:
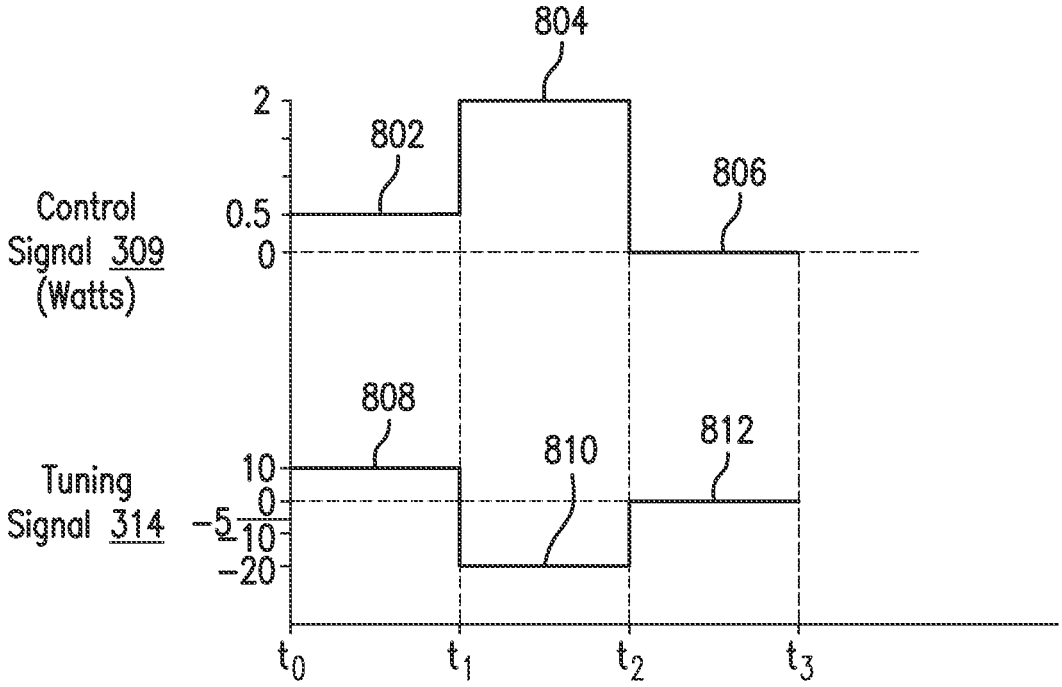
FIG. 8 is a wave diagram illustrating the operation of the polarity conditioner of FIG. 3 and the system of FIG. 2 in a second scenario.

FIG. 8 is a wave diagram illustrating the operation of polarity conditioner 302 and PLL 202 in a second scenario.

The figure includes examples of analog control signal 128 and tuning signal 314 as shown in FIG. 3.

Analog control signal 128 includes a first reflected power level 802 from time $t_0$ to $t_1$, a second reflected power level 804 from time $t_1$ to $t_2$, and a third reflected power level 806 from time $t_2$ to $t_3$. Tuning signal 314 includes a first modification value 808 from time $t_0$ to $t_1$, a second modification value 810 from time $t_1$ to $t_2$, and a third modification value 812 from $t_2$ to $t_3$.

In this example, at time $t_1$, first reflected power level 802 may have a value of 0.5 watts, indicating the amount of reflected power back to transmitter 102, whereas first modification value 808 may have a value of 10, indicating the amount of change tunable matching network 106 should apply to modify tunable impedance $Z_3$.

At time $t_2$, second reflected power level 804 has been increased to 2 watts. The increase in value of analog control signal 128 indicates tunable matching network 106 is modifying tunable impedance $Z_3$ in the wrong direction as there is more power reflected back to transmitter 102. In response, second modification value 810 changes polarity and may have a value of −20 to instruct to tunable matching network 106 to modify tunable impedance $Z_3$ in the reverse direction and also to compensate for the incorrect modification at time $t_1$.

At time $t_3$, third reflected power level 806 may have a value of 0 watt, which is a decrease from second reflected power level 804. The value of 0 watt indicates that tunable matching network 106 has tuned $Z_3$ in the right direction and there is no more impedance mismatching between source impedance $Z_1$ and antenna impedance $Z_2$.

As a result, third modification value 812 may have a value of 0 as there is no tuning necessary.

FIG. 8 illustrates that situation where a current control signal is greater than a previous controls signal, as discussed above with reference to FIG. 6 (S614 Yes). In this situation, tunable impedance $Z_3$ was modified in the wrong direction, thus the reflected signal is initially increased. The increase in the reflected signal is then detected by polarity conditioner 302, which subsequently modifies tunable impedance $Z_3$ in the correct direction.

As noted in FIG. 2-7, PLL 202 instructs tunable matching network 106 the amount of tuning needed to modify tunable impedance $Z_3$ in order to provide impedance matching between source impedance $Z_1$ and antenna impedance $Z_2$ via tuning signal 314. Polarity conditioner 302 switches the polarity of tuning signal 314 if the magnitude of analog control signal 128 is increasing to ensure tunable matching network 106 is modifying tunable impedance $Z_3$ in the correct direction.

PLL 202 and polarity conditioner 302 ensure that source impedance $Z_1$ and antenna impedance $Z_2$ are properly matched, thus maximizing the amount of transmission power while minimizing the amount of reflected power.

Tunable matching networks have been known to compensate for a impedance mismatch between an antenna and a transmitter. However, conventional systems for controlling tunable matching networks are complicated and expensive, such systems include microprocessors and look-up tables. In accordance with example embodiments of the present invention, a simple system is provided for tuning a tunable matching network, wherein the system includes the use of a PLL.

The foregoing description of various preferred embodiments of the invention have been presented for purposes of illustration and description. It is not intended to be exhaustive or to limit the invention to the precise forms disclosed, and obviously many modifications and variations are possible in light of the above teaching. The example embodiments, as described above, were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A system for impedance matching in antennas comprising:

a transmitter configured to output an electrical transmission signal;

an antenna configured to output an electromagnetic signal based on the electrical transmission signal, the antenna having an antenna impedance that varies as a function of ambient electromagnetism, said system comprising:

a radio frequency power detection portion configured to output a transmitted signal based on the transmission signal received from the transmitter;

a tunable matching network operably coupled between the radio frequency power detection portion and the antenna, the tunable matching network having a tunable impedance and being configured to output an output signal based on the transmitted signal and to reflect a reflected signal to said radio frequency power detection portion, the reflected signal being based on the antenna impedance and the tunable impedance;

a phase lock loop comprising a voltage controlled oscillator, wherein the phase lock loop is operably coupled between the radio frequency power detection portion and the tunable matching network, and a polarity conditioner comprising a sample and hold circuit and a comparator;

wherein said radio frequency power detection portion is further configured to output a control signal based on the reflected signal, wherein said phase lock loop is configured to output a tuning signal based on the control signal, and wherein said tunable matching network is configured to modify the tunable impedance based on the tuning signal to attenuate the reflected signal, wherein said sample and hold circuit is configured to output a current output and a previous output, and wherein said comparator is configured to compare the current output with the previous output, and wherein said polarity conditioner is configured to output a first signed reference frequency signal when the current output is larger than the previous output, and wherein said polarity conditioner is configured to output a second signed reference frequency signal when the current output is smaller than the previous output.

2. A method of using with a transmitter and an antenna, the transmitter being configured to output an electrical transmission signal, the antenna being configured to output an electromagnetic signal based on the electrical transmission signal, the antenna having an antenna impedance that varies as a function of ambient electromagnetism, said method comprising:

outputting, via a radio frequency power detection portion, a transmitted signal based on the transmission signal received from the transmitter;

outputting, via a tunable matching network operably coupled between the radio frequency power detection portion and the antenna and having a tunable impedance, an output signal based on the transmitted signal;

reflecting, via the tunable matching network, a reflected signal to the radio frequency power detection portion, the reflected signal being based on the antenna impedance and the tunable impedance;

outputting, via the radio frequency power detection portion, a control signal based on the reflected signal;

outputting, via a phase lock loop operably coupled between the radio frequency power detection portion and the tunable matching network, a tuning signal based on the control signal, wherein the phase lock loop comprises a voltage controlled oscillator;

matching, via a polarity conditioner comprising a sample and hold circuit and a comparator, the polarity of the tuning signal and the control signal; and modifying, via the tunable matching network, the tunable impedance based on the tuning signal to attenuate the reflected signal, wherein said sample and hold circuit is configured to output a current output and a previous output, and wherein said comparator is configured to compare the current output with the previous output and wherein said polarity conditioner is configured to output a first signed reference frequency signal when the current output is larger than the previous output, and wherein said polarity conditioner is configured to output a second signed reference frequency signal when the current output is smaller than the previous output.

* * * * *